US006044595A

United States Patent [19]

Snow

[11] Patent Number: 6,044,595

[45] Date of Patent: Apr. 4, 2000

[54] BILLBOARD NETTING SYSTEM PROVIDING PROTECTION FROM BIRDS

[75] Inventor: Roger Snow, Belvedere, Calif.

[73] Assignee: Hot Foot America L.P., Belvedere, Calif.

[21] Appl. No.: 09/243,189

[22] Filed: Feb. 2, 1999

[51] Int. Cl.[7] ..... A62B 3/00

[52] U.S. Cl. ..... 52/101; 43/1; 43/134; D20/39; D30/199; 256/11; 47/21; 47/20; 47/28.1; 182/138

[58] Field of Search ..... 52/101; 43/1, 134; 256/11; 47/20, 21, 28.1, 31; 56/329; 182/138; D30/199; D20/39; D5/11

[56] References Cited

U.S. PATENT DOCUMENTS

| | | | |
|---|---|---|---|
| D. 357,771 | 4/1995 | Townsend, III et al. . | |
| 1,585,503 | 5/1926 | Larsen . | |
| 2,989,789 | 6/1961 | Cohn . | |
| 4,100,706 | 7/1978 | White . | |
| 5,083,396 | 1/1992 | Traut | 47/28.1 |
| 5,410,982 | 5/1995 | Mann . | |
| 5,456,043 | 10/1995 | Dacon, Sr. | 47/21 |
| 5,497,585 | 3/1996 | Engler . | |

OTHER PUBLICATIONS

Bird Barrier Product Catalog, Zippers, p. 15, *Bird Barrier America, Inc.,* 1997.

*Primary Examiner*—Carl D. Friedman
*Assistant Examiner*—Jennifer I. Thissell
*Attorney, Agent, or Firm*—Flehr Hohbach Test Albritton & Herbert LLP

[57] ABSTRACT

A billboard netting system for a billboard (10) including top netting pieces (40, 46, 48), side netting pieces (50, 54, 56, 58), and bottom netting piece (52). Such netting pieces enclose potential bird nesting structure of the billboard, yet allow for easy access to the catwalks (24, 26, 28, 30, 32, 34) of the billboard. As a result, billboards 12, 16 are exterior of the netting pieces.

4 Claims, 8 Drawing Sheets

146
134
134
140
120
134
130
125
134
142
150
134
170
144
124
126
124
134
170
150'
148
154
166
126
123
122
126
170
160
164
162
132
156

140'
140'
180
130
180
170
166
124
126
144
170
122
170
172'
156
162
160
164

BILLBOARD NETTING SYSTEM PROVIDING PROTECTION FROM BIRDS

TECHNICAL FIELD

The present invention relates to netting systems for protecting structures from pest birds and, more particularly, to a netting system specifically designed for billboards to prevent pest birds from nesting in the support structure of the billboard and dropping on objects and people below the billboard.

BACKGROUND ART

Billboards present a particularly inviting structure for birds to rest and nest within, primarily due to the relatively remote locations of billboards and their often sunny perches. As a result, billboards have for years created a host of problems associated with bird nesting activities. Perhaps the most serious problem created by nesting birds are health risks from bird droppings. It is common for birds to spread diseases through their droppings, either through direct contact with the droppings, via droppings that mix with food and water sources, as a result of fecal dust from bird feces, and from the parasites that birds harbor, such as fleas, ticks and mites. When billboards are positioned in areas frequented by the general public, such as parks and playgrounds, these health risks are magnified.

Another problem associated with pest birds is the mess, stains and physical damage that results from bird droppings. Billboards positioned, for example, adjacent new car lots result in numerous bird droppings ruining the finishes on new cars parked on the lot. Billboards positioned on rooftops result in a pile-up of bird droppings on the roof and sometimes bird droppings dripping down the side of the building, which not only is unsightly but can result in damage to roofing and siding material.

U.S. Pat. No. 5,497,585 discloses a bird anti-perching device in the form of a plurality of rotatable rings strung consecutively on a cable supported above the top frame of a billboard. Birds attempting to land on the top frame of the billboard will necessarily have to land on the string of rings, which due to their free rotation do not provide a stable landing platform, forcing the birds to fly away. However, the rings do not prevent birds from landing and nesting in the support frame of the billboard, which is where birds desire to nest due to the somewhat enclosed nature of the structure.

Other bird anti-perching devices include expandable foam, spikes, electrical shock wires, coils, mechanical wires, and gels that birds do not like to step in.

Attempts have been made to string netting around billboards and their support structure, as well as around other structures, but it has proven difficult to securely fasten the netting so that it remains in tact, and to arrange the netting in a manner that does not interfere with maintenance of the billboard and replacement of billboard signs. Typically, netting is secured around as much of the structure as possible in order to protect every possible landing site from bird intrusion. However, such over-protection of the structure is expensive and often interferes with maintenance and repair.

As a result, there is a need for improved methods of protecting billboard structures from nesting birds, which at the same time allows maintenance personnel maximum access to the billboard.

DISCLOSURE OF INVENTION

Briefly described, the netting system of the present invention is designed for enclosing the area between back-to-back billboards of the type having a support structure including a torsion bar for supporting the billboards in a back-to-back relationship with the billboards facing generally away from each other. The support structure of the billboard comprises upper and lower catwalks between the billboards for providing maintenance personnel access to tie down straps that secure signs to the billboards. The netting system includes upper netting sections that extend between lateral side edges of the upper catwalk and inner sides of each billboard and enclose the under side of the upper catwalk but leave the top side of the upper catwalk exposed. The netting system also includes side netting sections that extend down from the upper catwalks and enclose the outer sides of the area between the billboards. Finally, the netting system includes a bottom netting section that extends between the billboards and encloses the bottom side of the area between the billboards.

According to an aspect of the invention, the support structure includes a pair of spaced upper catwalks and the upper netting sections include a horizontal section of netting extending between lateral side edges of each upper catwalk to enclose the area between the upper catwalks.

An advantage of the netting system of the present invention is the maximization of usable space on the billboard structure. The netting system is designed to enclose only the necessary billboard structure found desirable by birds for nesting purposes. The rest of the billboard structure can by exposed, which may result in a stray bird or two temporarily resting on an exposed structural member, but essentially eliminates any possibility of birds attempting to build nests on the billboard. As a result, the associated problems of cleanliness are substantially reduced if not entirely eliminated.

According to another aspect of the invention, the support structure includes a longitudinal torsion bar and wherein the bottom netting section encloses the upper edge of the torsion bar so that birds cannot gain access to and land on the upper edge.

According to an alternative design for the netting system, the upper netting sections enclose the area between the billboards by extending up to the back sides of the billboards in a manner that does not interfere with access to the tie-down straps that hold the signs to the front side of the billboards.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
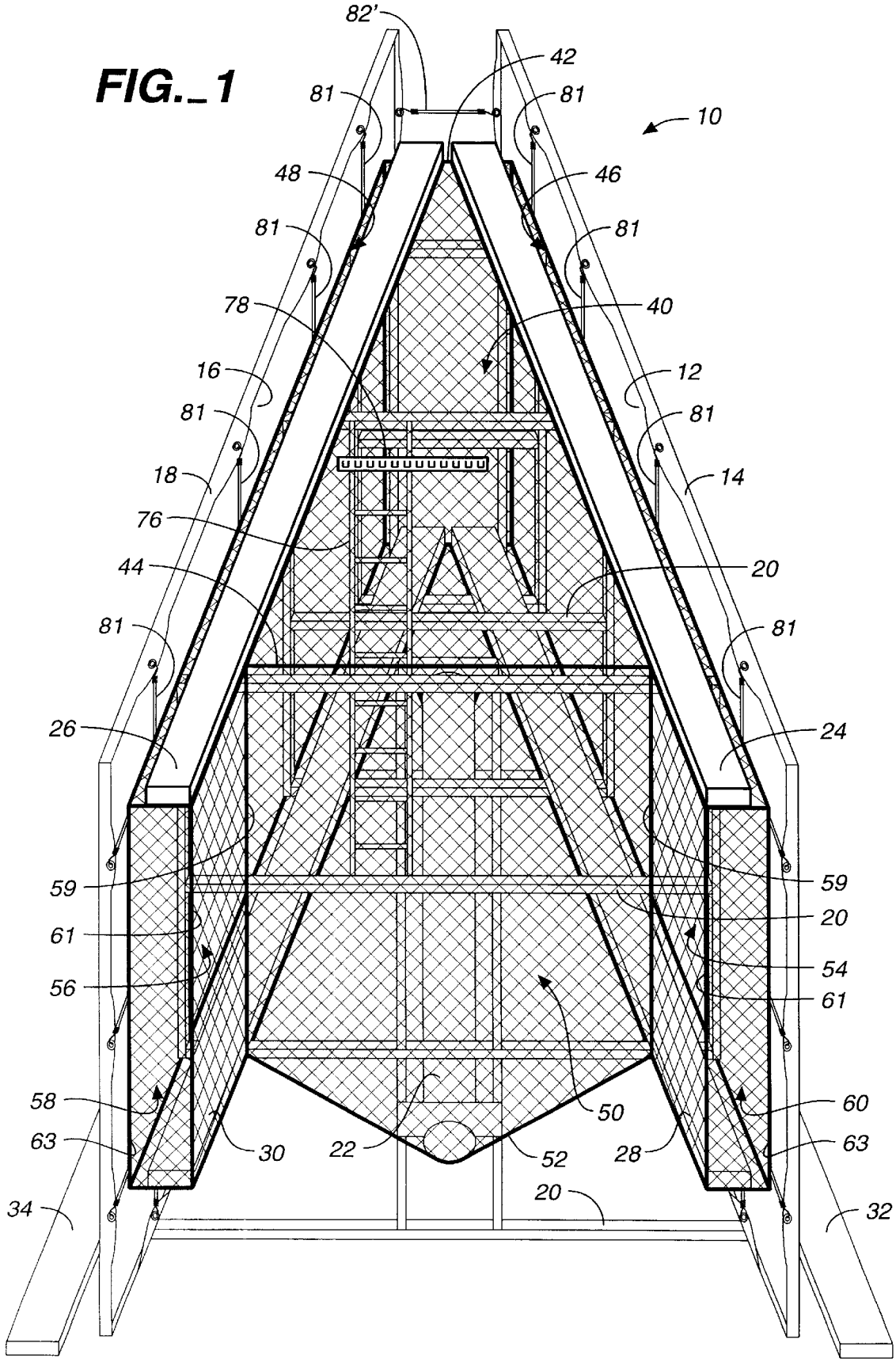
FIG. 1 is a pictorial view of a netting system for a V-shaped dual billboard structure.

Referring to FIG. 1, a V-shaped dual billboard 10 includes a first billboard facade 12 shown with a billboard sign 14 draped over it and secured around its edges thereto, and a second billboard facade 16 shown with a second billboard sign 18 draped over and secured thereto. The V-shaped configuration is a common billboard structure and the particular angle between the two billboards 12, 16 is not essential to the present invention.

Billboards 12, 16 are supported by a frame structure 20, which is secured to and supported by a large horizontal torsion bar 22, which in turn is supported by the main upright column (not shown) of the billboard. Frame structure 20 includes a variety of transverse, longitudinal, and vertical beams and rails that are discussed in more detail with reference to FIG. 2. Frame structure 20 supports a pair of upper catwalks 24, 26 and a pair of lower, inside catwalks 28, 30. Also, a pair of lower, outside catwalks 32, 34 are also provided and supported by a frame structure discussed with reference to FIG. 3.

Figure 2:
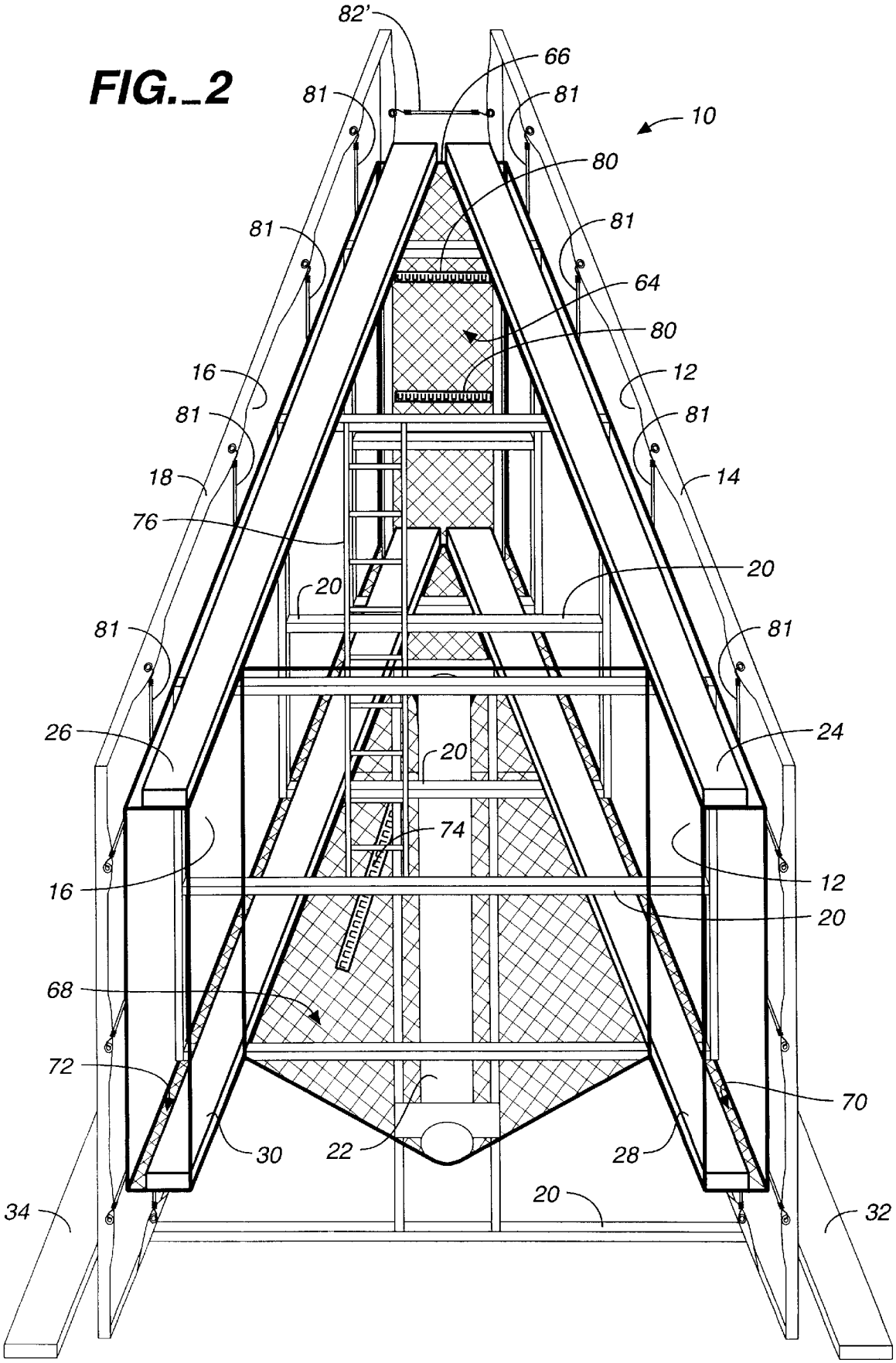
FIG. 2 is a pictorial view like FIG. 1 of a V-shaped dual billboard shown with foreground netting removed.

Because the enclosed netting system of the present invention is difficult to illustrate in a single figure, FIG. 1 is used to show the netting in the foreground and on top of the billboard structure, while FIG. 2 is used to show the netting system at the back and along the bottom of the billboard structure. The netting shown in FIG. 1 includes a V-shaped top panel 40, which conforms to the V-shape of the upper catwalks 24, 26 and extends from its apex 42 to side edge 44 that is spaced inwardly from the wide end of the billboard structure 10.

The netting system also includes a pair of long and narrow top side edge panels 46, 48, which extend between their adjacent upper catwalks 26, 28 and billboard facades 12, 16, a wide end wall panel 50, which extends from upper edge 44 down to a wide angle V-shaped lower edge 52, which is discussed in more detail with reference to FIG. 5. The netting system also includes a pair of wide end inwardly facing panels 54, 56, which extend across between edges 59, 61, and a pair of wide end edge panels 58, 60, which extend between edges 61, 63.

Referring to FIG. 2, the netting system also includes a narrow, end panel 64, which extends from upper edge 66 adjacent upper catwalks 24, 26 down to a lower V-shaped edge (not shown) at the end of horizontal torsion bar 22. The netting system also includes a V-shaped bottom panel 68, which extends between the inside edges of lower, inside catwalks 28, 30 and down under horizontal torsion bar 22. A pair of narrow, lower side edge panels 70, 72 extend between lower inside catwalks 28, 30 and the insides of billboard facades 12, 16, in a manner similar to the positioning of top side edge panels 70, 72.

Referring to FIGS. 1 and 2, bottom panel 68 includes an access zipper 74, which provides access into the interior of the netting system from below. The design of the access ladders and catwalks from below is discussed in more detail with reference to FIG. 3. Through zipper 74, maintenance personnel can access ladder 76, which is mounted on transverse frame members 20, and gain access onto lower inside catwalks 28, 30. Top panel 40 also includes an access zipper 78, which provides access from ladder 76 up onto upper catwalks 24, 26. Once up on upper catwalks 24, 26, maintenance personnel are outside of the enclosed netting structure and can freely access tie-down straps 81 that secure billboards 14, 18 to the frame structure of the billboard. Back panel 64 includes zippers such as 80 that allow maintenance personnel to access from lower inside catwalks 28, 30 tie-down straps 82' that secure the sides of billboards 14, 18 to each other. Upper tie-down strap 82' is accessible from upper catwalks 24, 26.

Figure 3:
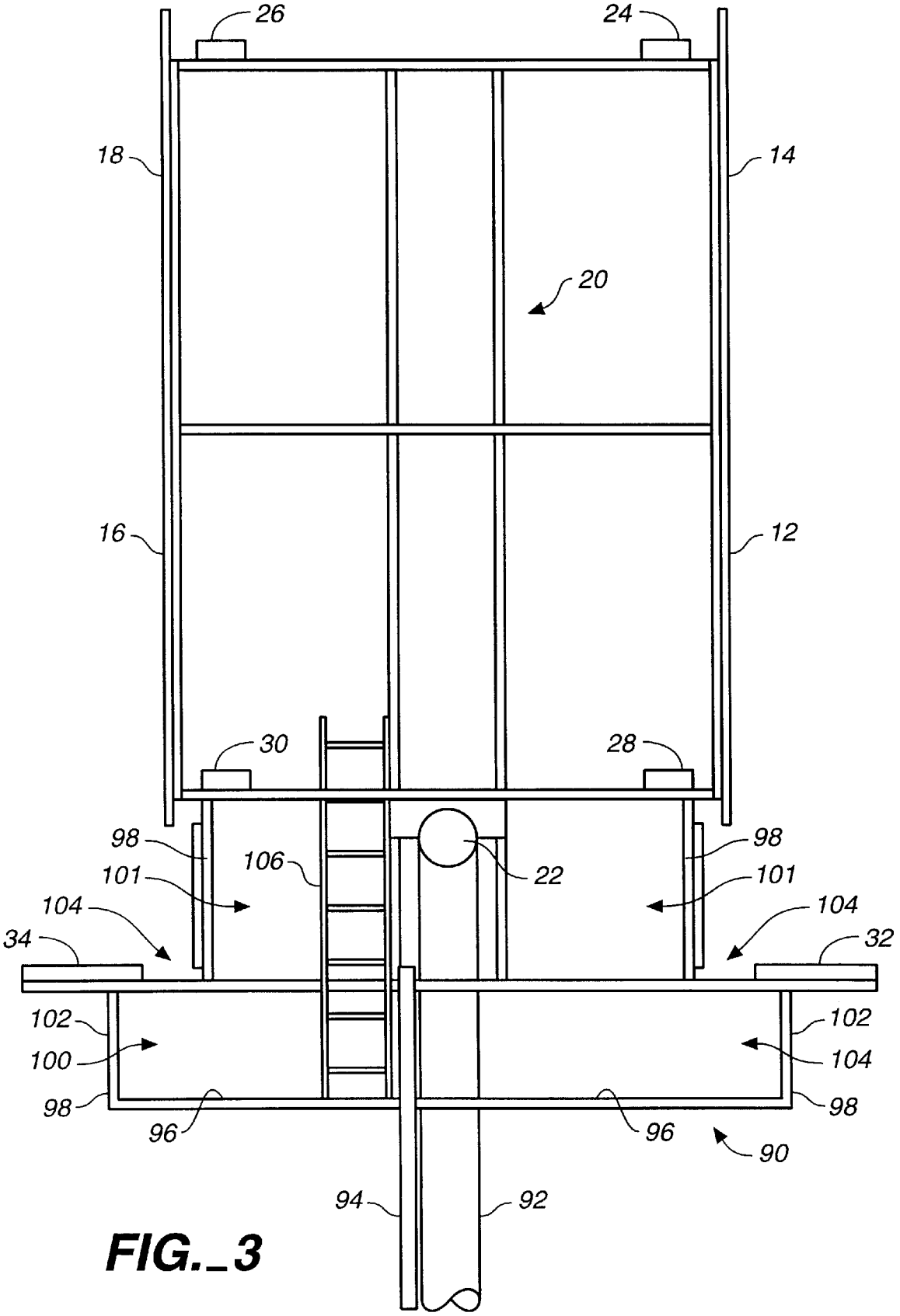
FIG. 3 is a sectional view of the dual billboard of FIG. 1, taken at the transverse auxiliary catwalk.

FIG. 3 illustrates a transverse auxiliary catwalk structure 90 that, for clarity, is not illustrated in FIGS. 1 and 2, but which is mounted immediately adjacent main vertical support column 92 that supports the billboard structure. Auxiliary catwalk structure 90 extends transversely of billboards 12, 16 and is located adjacent support column 92 so that maintenance personnel climbing up ladder 94 can easily step off of the ladder and onto a transverse catwalk 96 to gain access to outer longitudinal catwalks 32, 34. Catwalk 96 is sufficiently wide (into and out of the page as illustrated) to accommodate at least one person and preferably is sufficiently wide to allow two people to pass one another.

A frame structure 98 supports transverse catwalk 96 and allows for netting (not shown) to enclose side areas 100, 101 and end areas 102. The transverse catwalk itself encloses the bottom of frame structure 98. To enclose the upwardly exposed sides of frame structure 98, netting is provided at 104. Netting 104 each includes a zipper (not shown) or S-hooks to permit maintenance personnel to step up off of transverse catwalk 96 and out onto outer catwalks 32, 34.

Auxiliary catwalk structure 90 also includes a short ladder 106 that allows maintenance personal to step up onto lower inside catwalk 30. Ladder 106 extends from transverse catwalk 96 up to a point above the level of inner catwalk 30. Maintenance personnel can step from the top of ladder 106 over onto catwalk 30, and then can walk down and around to gain access to catwalk 28.

Figure 4:
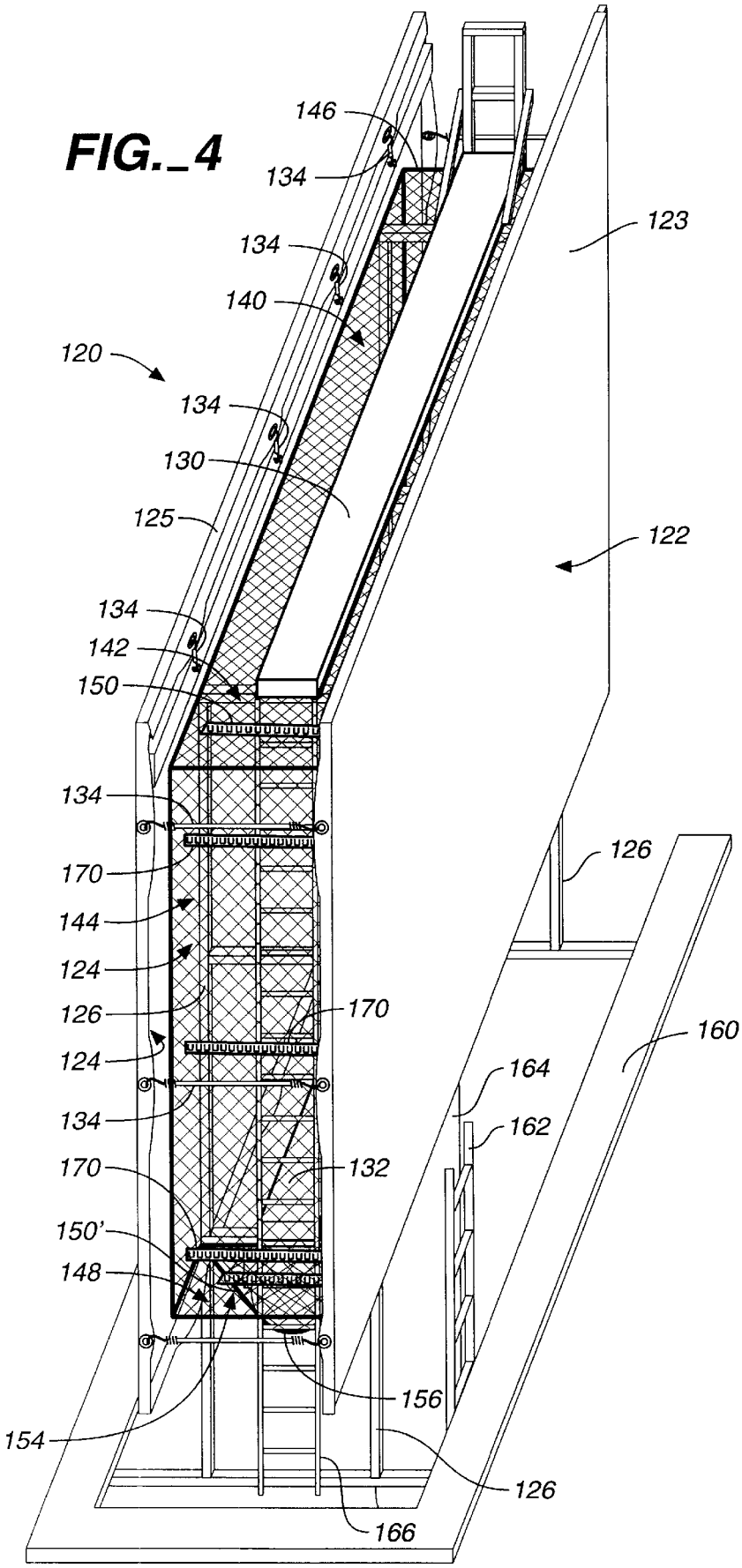
FIG. 4 is a pictorial view of a netting system for back-to-back billboards.

FIG. 4 shows a back-to-back billboard structure 120 that incorporates features of the invention and includes a front billboard 122 and a back billboard 124 with respective billboard signs 123, 125 secured thereon. A frame structure 126 supports billboards 122, 124 in a spaced, parallel arrangement. Supported on frame structure 126 is an upper catwalk 130 and a lower, inside catwalk 132. Tie-downs 134 extend down to frame members of billboards 122, 124 and secure the billboards to their respective facades.

The netting system for billboard structure 120 includes a top netting piece 140 that extends between upper catwalk 130 and each billboard 122, 124 and also includes a side extension piece 142 that extends longitudinally toward the side edges of the billboards. The netting system also includes side panels 144, 146 for enclosing the sides of the billboard structure 120 and a bottom side extension piece 148, which is similar in size and position to upper side extension piece 142. Both the upper and bottom extension pieces 142, 148 include zippers 150 for access, as discussed later. Finally, the netting system includes a V-shaped bottom piece 154, which extends between the bottom edges of the billboards, down underneath the horizontal torsion bar 156 of the billboard structure 120.

Billboard structure 120 also includes a U-shaped outer catwalk 160, which is supported by frame structure 126. A ladder 162 is secured to an upright support column 164 and provides access to outer catwalk 160. A second side ladder 166 is mounted to frame structure 126 and is positioned within netting pieces 142, 144, 148. Maintenance personnel can gain access to inner catwalk 132 by climbing up ladder 166 through lower zipper 150' and stepping around onto catwalk 132. Access to upper catwalk 130 is through upper zipper 150. Additional side zippers such as 170 provide access to the tie-downs 134 on the side of the billboard structure.

Figure 5:
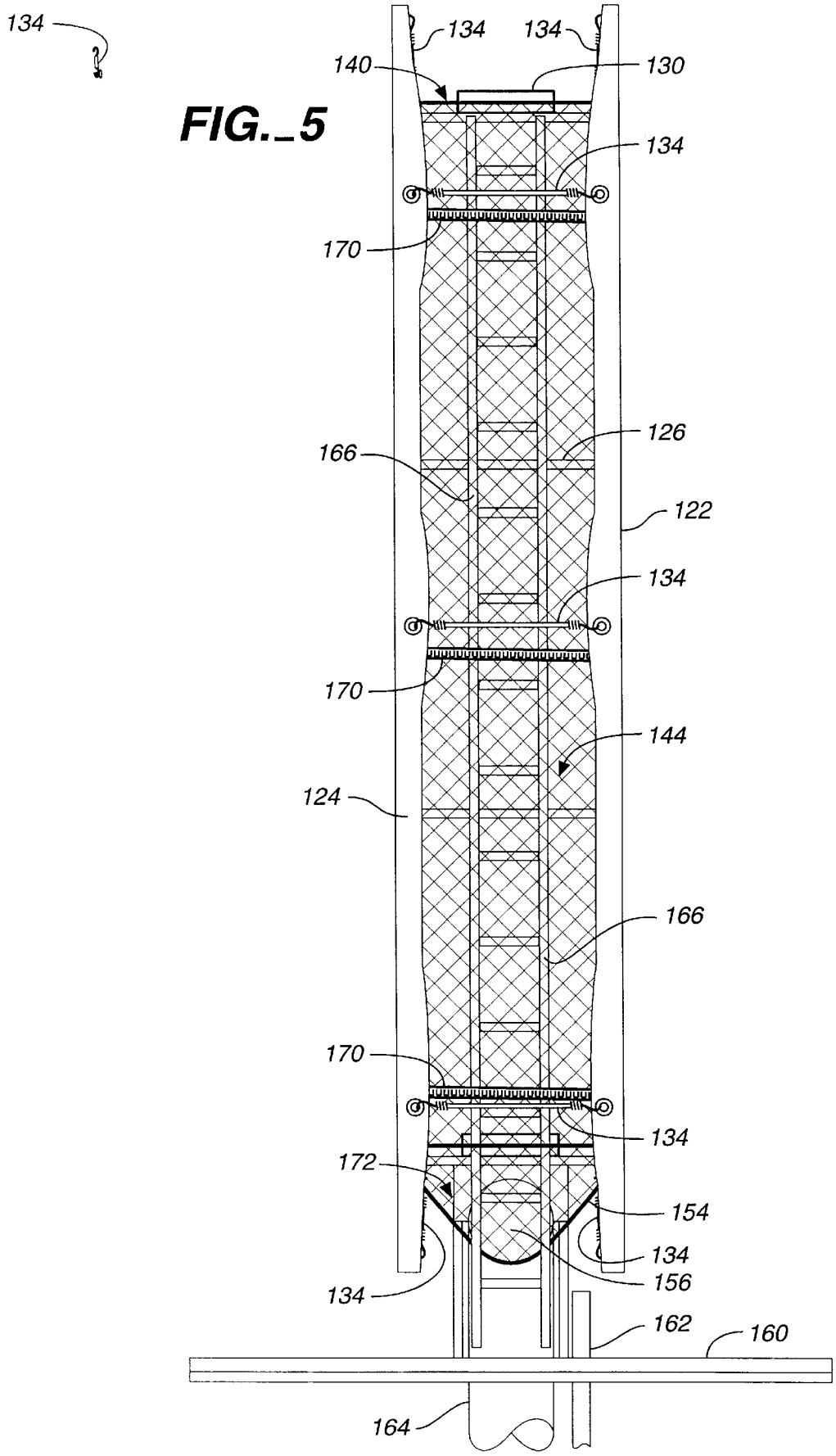
FIG. 5 is an end elevation view of the back-to-back billboards of FIG. 4.

Referring to FIG. 5, the netting system also includes a bottom side filler piece 172 that closes the space at one end of horizontal torsion bar 156. A similar filler piece is placed at the other end of the torsion bar. FIG. 5 also shows how the V-shaped bottom netting piece 154 extends down underneath horizontal torsion bar 156.

Figure 6:
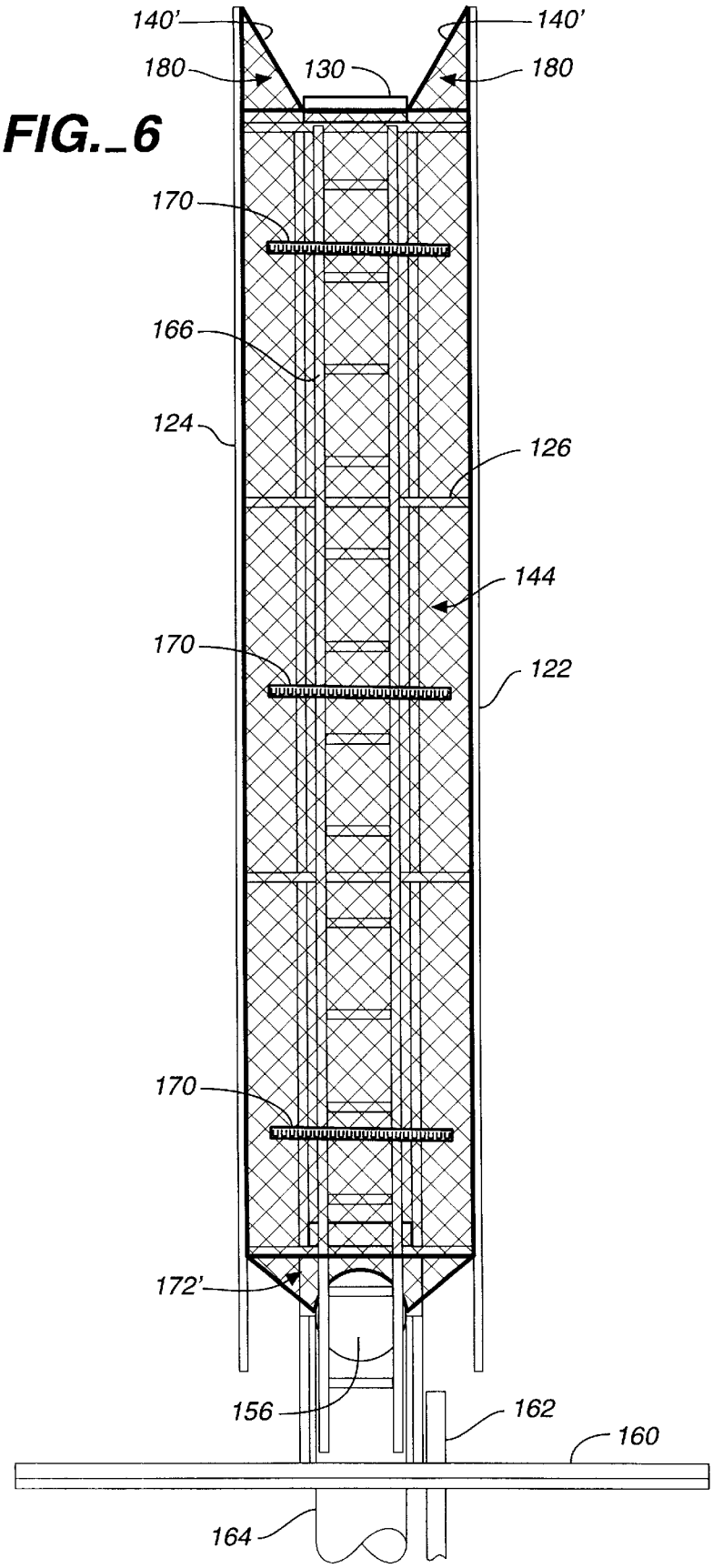
FIG. 6 is an end elevation view of a back-to-back billboard shown with an alternative design for securing the netting on the top and bottom sides of the billboard structure.

Referring to FIG. 6, an alternative design is shown to that of FIG. 5. Instead of flat top netting piece, an upwardly angled top netting piece 140' is provided between upper catwalk 130 and billboards 122, 124. Triangular end netting pieces 180 are also provided at each end of catwalk 130. With this design, the upper catwalk is still outside of the netting system and thus provides many of the advantages associated therewith such as easy access, but this design also encloses the top portion of each billboard 122, 124, which may be desirable to prevent birds from nesting on any structural that are above catwalk 130.

The alternative netting system design shown in FIG. 6 also includes a modified bottom netting piece 172'. For some applications, it may be easier to drape the bottom netting piece over horizontal torsion bar 156 rather than underneath it.

Figure 7:
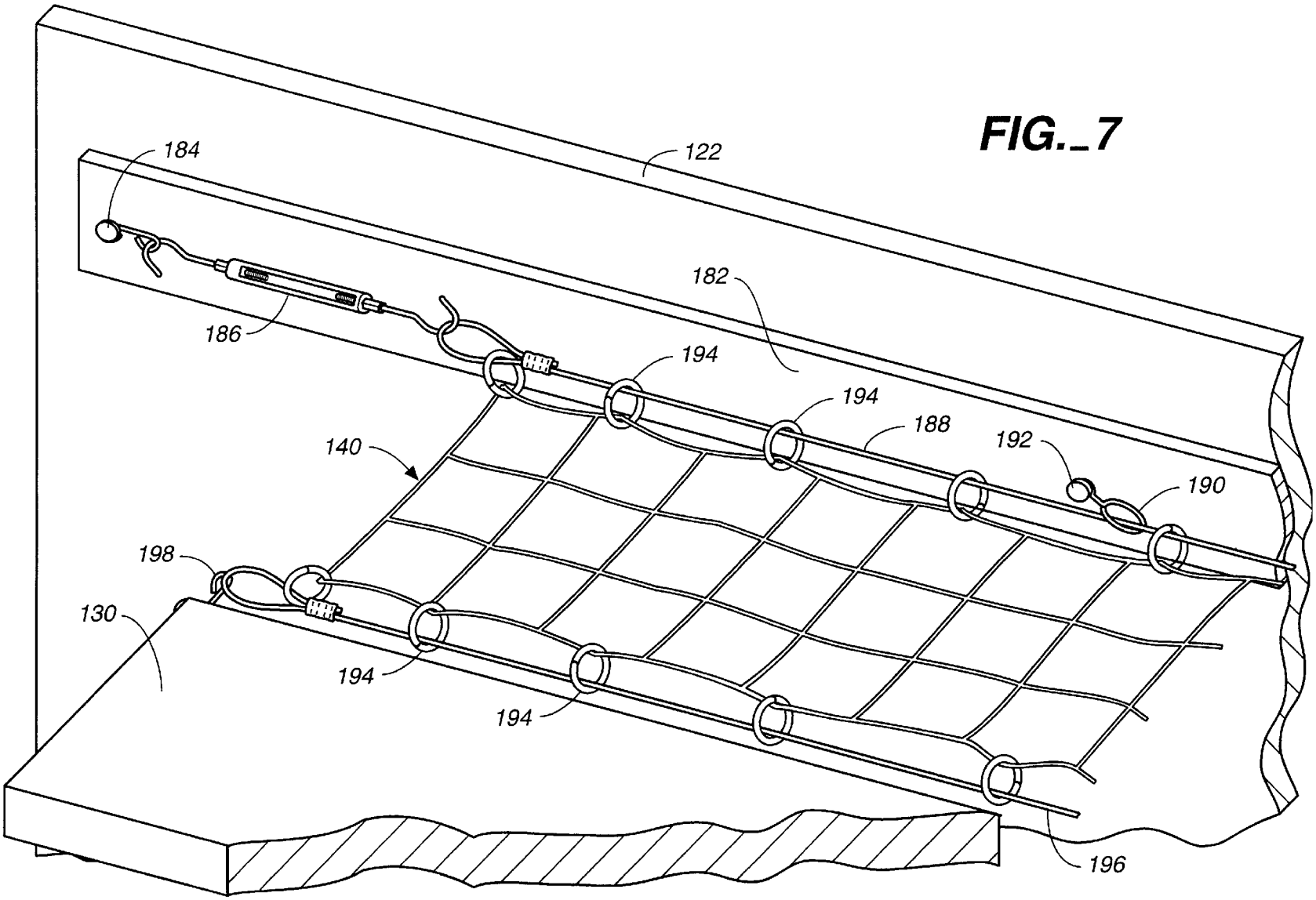
FIG. 7 is a enlarged pictorial view of a portion of the cable and connector ring system for securing netting to parts of a billboard structure.
Figure 8:
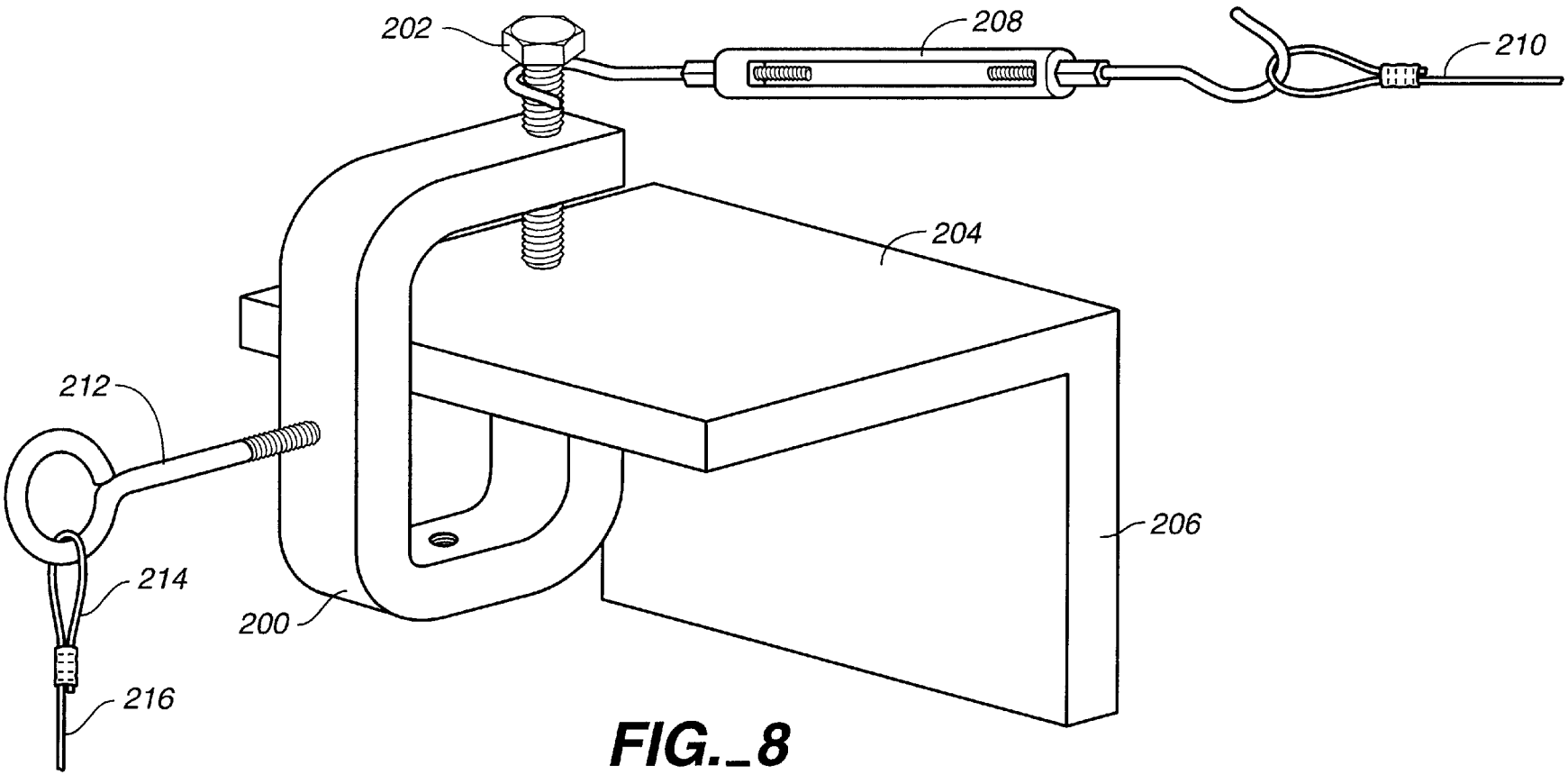
FIG. 8 is an enlarged pictorial view of an alternative design for securing cabling for billboard netting.

Either method provides sufficient protection from nesting birds. FIGS. 7 and 8 show two different methods of attaching cable to the billboard structure in order to secure the netting material in place. In FIG. 7, the billboard 122 of FIG. 4 includes a horizontal structural frame board 182. Secured at one end of board 182 is an eyebolt 184 with a tensioner in the form of a turnbuckle 186 attached thereto. A cable 188 is secured to the inner end of tensioner 186 and intermittently spaced clips 190 held by anchor screws 192 provide support to hold cable 188 in position for securing netting piece 140. Depending on the type of bird to be repelled, anchor screws 192 may be spaced from 3'–6' apart. Hog rings 194 are then secured around cable 188 and the outer strand of netting 140, preferably to each alternate net square.

Similarly, a second cable 196 is secured along the inside edge of upper catwalk 130. A clip 198 secured by an anchor screw is mounted at one end of the catwalk and cable 196 is secured thereto. A tensioner is positioned at the other end of the cable. Also, hog rings 194 loop around cable 196 and around an outer strand of netting 140. In this manner, netting piece 140 is secured in position in a relatively taught manner with sufficient tension throughout to prevent birds from entering into the sub-structure of the billboard.

The connection system of FIG. 7 works best for wood frame structures. For metal frame members, a beam clamp 200 is utilized, as shown in FIG. 8. Beam clamp 200 includes an adjustable mounting bolt 202 that clamps down onto a side edge 204 of metal beam 206. A turnbuckle tensioner 208 clips around mounting bolt 202 and holds one end of a cable 210. Beam clamp 200 also includes one or more lateral eye bolts 212 that provides for securing an end loop 214 of a second cable 216 in a direction 90° from that of cable 210. Additional eyebolts can be secured to beam clamp 200 as required.

An advantage of the netting system of the present invention is the maximization of usable space on the billboard structure. The netting system is designed to enclose only the necessary billboard structure found desirable by birds for nesting purposes. The rest of the billboard structure can by exposed, which may result in a stray bird or two temporarily resting on an exposed structural member, but essentially eliminates any possibility of birds attempting to build nests on the billboard. As a result, the associated problems of cleanliness are substantially reduced if not entirely eliminated.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

The invention claimed is:

1. A netting system for enclosing the area between back-to-back billboards of the type which comprises in combination: back-to-back billboards having a support structure including a torsion bar for supporting the billboards in a back-to-back relationship with the billboards facing generally away from each other, the support structure comprising upper and lower catwalks between the billboards for providing maintenance personnel access to tie down straps that secure signs to the billboards, upper netting sections that extend between lateral side edges of the upper catwalk and inner sides of each billboard and enclose the under side of the upper catwalk but leave the top side of the upper catwalk exposed, side netting sections that extend down from the upper catwalks and enclose the outer sides of the area between the billboards, and a bottom netting section that extends between the billboards and encloses the bottom side of the area between the billboards.

2. The netting system of claim 1 wherein, the support structure includes a pair of spaced upper catwalks and the upper netting sections include a horizontal section of netting extending between lateral side edges of each upper catwalk to enclose the area between the upper catwalks.

3. The netting system of claim 1 wherein, the support structure includes a longitudinal torsion bar and wherein the bottom netting section encloses the upper edge of the torsion bar so that birds cannot gain access to and land on the upper edge.

4. The netting system of claim 1 wherein, the upper netting sections enclose the area between the billboards by extending up to the back sides of the billboards in a manner that does not interfere with access to the tie-down straps that hold the signs to the front side of the billboards.

* * * * *

UNITED STATES PATENT AND TRADEMARK OFFICE

CERTIFICATE OF CORRECTION

PATENT NO : 6,044,595
DATED : APRIL 4, 2000
INVENTOR(S) : ROGER SNOW

It is certified that error appears in the above-identified patent and that said Letters Patent are hereby corrected as shown below:

In Col. 4, line 35, after "maintenance" and before "to step up", delete "personal" and insert therefor --personnel--.

In Col. 5, line 22, after "structural" and before "that are above", insert therefor --structure that is--.

In Col. 5, line 48, after "relatively" and before "manner", delete "taught" and insert therefor --taut--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*